US011162306B2

(12) United States Patent
Simonsen et al.

(10) Patent No.: US 11,162,306 B2
(45) Date of Patent: Nov. 2, 2021

(54) DOWNHOLE FIBER OPTIC WET MATE CONNECTIONS

(71) Applicant: WEATHERFORD TECHNOLOGY HOLDINGS, LLC, Houston, TX (US)

(72) Inventors: Tore Simonsen, Klepp stasjon (NO); Tore Grødem, Sandnes (NO)

(73) Assignee: Weatherford Technology Holdings, LLC, Houston, TX (US)

( * ) Notice: Subject to any disclaimer, the term of this patent is extended or adjusted under 35 U.S.C. 154(b) by 204 days.

(21) Appl. No.: 16/529,624

(22) Filed: Aug. 1, 2019

(65) Prior Publication Data

US 2021/0032940 A1 Feb. 4, 2021

(51) Int. Cl.

| | |
|---|---|
| ***E21B 17/02*** | (2006.01) |
| *E21B 47/135* | (2012.01) |
| *E21B 33/12* | (2006.01) |
| *E21B 47/00* | (2012.01) |

(52) U.S. Cl.
CPC ..... *E21B 17/028* (2013.01); *E21B 33/12* (2013.01); *E21B 47/00* (2013.01); *E21B 47/135* (2020.05)

(58) Field of Classification Search
CPC ..... E21B 17/028; E21B 47/135; E21B 33/12; E21B 47/00; E21B 17/026
See application file for complete search history.

(56) References Cited

U.S. PATENT DOCUMENTS 7,640,977 B2 * 1/2010 Jonas ..... E21B 17/028 166/242.6
7,900,698 B2 * 3/2011 Stoesz ..... E21B 23/00 166/242.6
9,404,314 B2 * 8/2016 Perez ..... E21B 17/02
2005/0072564 A1 * 4/2005 Grigsby ..... E21B 17/023 166/65.1
2005/0074210 A1 * 4/2005 Grigsby ..... E21B 17/028 385/53

(Continued)

OTHER PUBLICATIONS

International Search Report with Written Opinion dated Dec. 22, 2020 for PCT Patent Application No. PCT/US2020/041630, 19 pages.

(Continued)

*Primary Examiner* — Steven A MacDonald
(74) *Attorney, Agent, or Firm* — Smith IP Services, P.C.

(57) ABSTRACT

A wet mate connection can include two connector assemblies, each connector assembly including at least one connector and a protective barrier displaceable between closed and open positions, and one connector assembly including an engagement device that displaces the protective barrier of the other connector assembly from the closed position to the open position in response to engagement between the connector assemblies. A method of making a connection between lines in a well can include installing a connector assembly, then installing another connector assembly, each connector assembly including a connector and an alignment profile, then axially compressing the connector assemblies, thereby opening protective barriers for the respective connectors, operatively connecting the connectors, and engaging the alignment profiles, thereby maintaining rotational alignment of the connectors. A system for use with a well can include a wet mate optical connection made between packers of the respective connector assemblies.

18 Claims, 18 Drawing Sheets

(56) References Cited

U.S. PATENT DOCUMENTS

| | | | | |
|---|---|---|---|---|
| 2005/0194150 | A1* | 9/2005 | Ringgenberg | E21B 47/07 166/380 |
| 2008/0029274 | A1* | 2/2008 | Rytlewski | E21B 17/1035 166/375 |
| 2015/0368983 | A1* | 12/2015 | Perez | E21B 17/021 166/378 |
| 2016/0356095 | A1* | 12/2016 | Perez | E21B 17/003 |

OTHER PUBLICATIONS

TE Connectivity Ltd.; "Rugged Fiber Optics", Aerospace, Defense & Marine article No. 9-1773456-9, dated Sep. 2016, 16 pages.

* cited by examiner

DOWNHOLE FIBER OPTIC WET MATE CONNECTIONS

BACKGROUND

This disclosure relates generally to equipment utilized and operations performed in conjunction with a subterranean well and, in an example described below, more particularly provides apparatus, systems and methods for downhole wet mate connections.

There are many uses for optical fibers in subterranean wells. These uses include, but are not limited to, sensing various downhole parameters, communication, data transmission, power transmission, etc.

In some situations, it is desirable or necessary to be able to make a connection between lines, such as sections of optical fiber, in a well. A connection made in a well environment (e.g., exposed to downhole fluids, temperatures and pressures) is known to those skilled in the art as a "wet mate" or "wet connect" connection.

It will, therefore, be readily appreciated that improvements are continually needed in the arts of designing, constructing and utilizing connectors for making downhole connections between lines in wells. Such improvements may be useful for wet mate connections made in a variety of different downhole environments.

DETAILED DESCRIPTION

Figure 1:
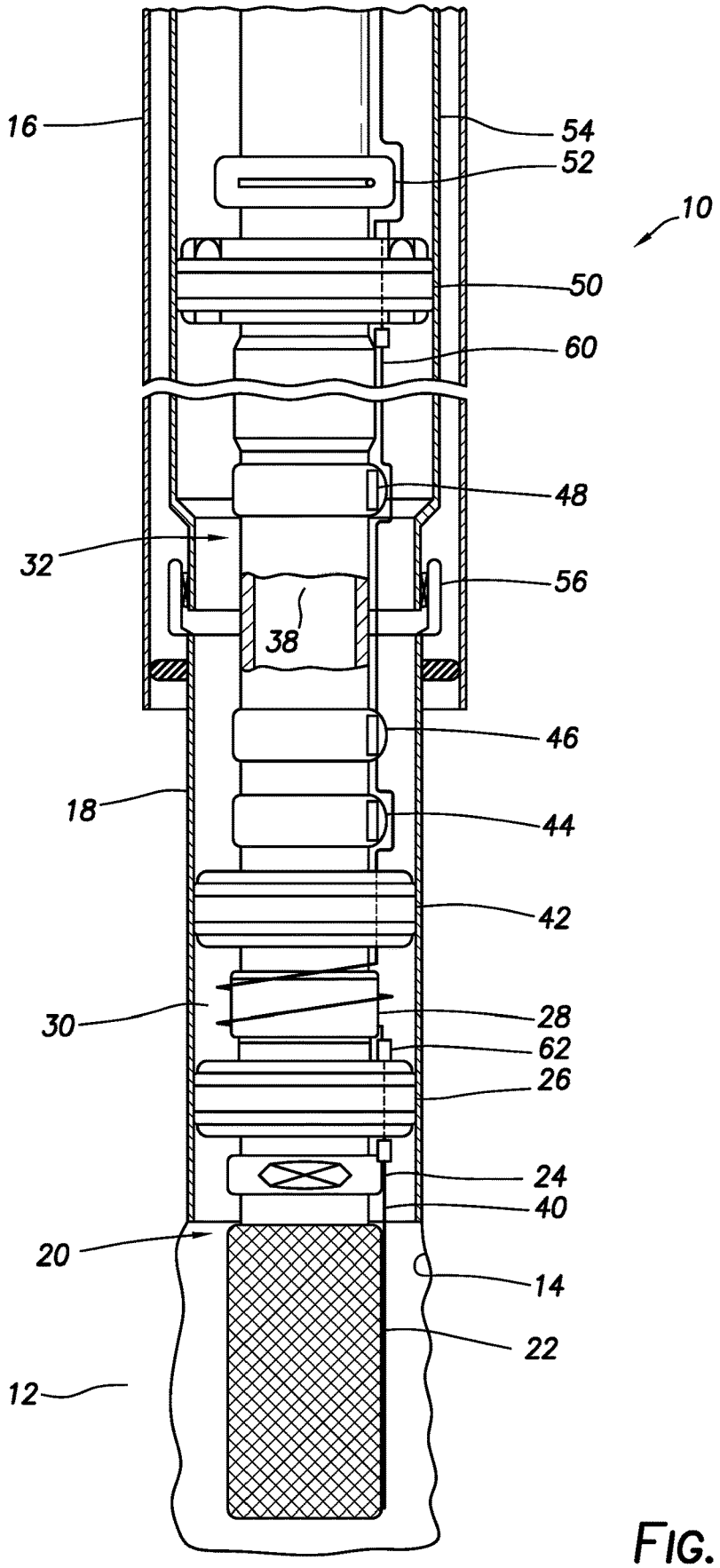
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, the well is a production well, in which it is desired to produce fluids from an earth formation 12 penetrated by a wellbore 14. An upper section of the wellbore 14 is lined with casing 16. A liner 18 is secured in a lower portion of the casing 16 and extends to an uncased section of the wellbore 14 from which the fluids are produced.

In other examples, other combinations or numbers of casing, liner or other tubulars may be used in the wellbore 14. In addition, the fluids may be produced from cased or uncased sections of the wellbore 14. Thus, the scope of this disclosure is not limited to any particular characteristics of the FIG. 1 example well.

As depicted in FIG. 1, a lower completion string 20 is installed in the liner 18. In this example, the lower completion string 20 includes a well screen 22, an isolation valve 24, a screen hanger or packer 26 and a polished bore receptacle 28.

The packer 26 is set in the liner 18, so that flow is prevented through an annulus 30 formed radially between the completion string 20 and the liner 18, and relative axial displacement between the packer and the liner is prevented. If the packer 26 is set in an uncased section of the wellbore 14, then the packer 26 can seal between the completion string 20 and the wellbore, and can anchor the completion string relative to the wellbore.

The lower completion string 20 also includes an optical fiber line 40. In this example, the optical fiber line 40 extends longitudinally along the lower completion string and to a lower end of the well screen 22. In other examples, the optical fiber line 40 may be otherwise positioned or arranged on or in the lower completion string 20.

The optical fiber line 40 may be used for sensing temperature, pressure, vibration, acoustic signals or any other downhole parameters. Alternatively, or in addition, the optical fiber line 40 may be used to transmit data, commands, light, power, or any other form of communication or transmission. The scope of this disclosure is not limited to any particular use of, or function performed by, the optical fiber line 40.

Produced fluids flow from the formation 12, into the uncased section of the wellbore 14, into the well screen 22, and then via the open valve 24 to surface (or near the surface, such as, a subsea production facility). An upper completion string 32 is engaged with the lower completion string 20 for conducting the produced fluids to the surface.

The polished bore receptacle 28 includes a seal bore 34 (not visible in FIG. 1, see FIG. 17), which receives therein an inner seal mandrel 36 (not visible in FIG. 1, see FIG. 17) of the upper completion string 32. This sealed engagement provides a continuous internal flow passage 38 extending longitudinally through the engaged lower and upper completion strings 20, 32.

The upper completion string 32 in this example includes the seal mandrel 36, a production packer 42, a chemical injection mandrel 44, pressure gauges 46, a gas lift valve 48, an isolation packer 50 and a safety valve 52. In other examples, different combinations or numbers of components may be used in the upper completion string 32.

The isolation packer 50 may be required by some jurisdictions. As depicted in FIG. 1, the packer 50 is set in an inner liner string 54 sealingly engaged with a tie back 56 at an upper end of the liner 18. The isolation packer 50 and the inner liner string 54 may not be used in some examples.

The production packer 42 seals between the upper completion string 32 and the liner 18, thereby isolating a section of the annulus 30 between the packers 42, 26. The packer 42 also anchors the upper completion string 32 to the liner 18, so that the engagement between the lower and upper completion strings 20, 32 is maintained.

The upper completion string 32 also includes an optical fiber line 60. As depicted in FIG. 1, the optical fiber line 60 extends longitudinally along the upper completion string 32, and is wrapped helically about the upper completion string at a lower end thereof (e.g., below the packer 42). The optical fiber line 60 may have any use, purpose or function, including but not limited to any of those uses, purposes or functions described above for the optical fiber line 40.

The upper completion string 32 is installed in the well after the lower completion string 20, and it is desired to make a wet mate connection 62 downhole between the optical fiber lines 40, 60 when the upper completion string is engaged with the lower completion string. For this purpose, the lower and upper completion strings 20, 32 include specially configured connector assemblies that house, protect, align and operatively connect optical connectors of the assemblies, as described more fully below.

Figure 2:
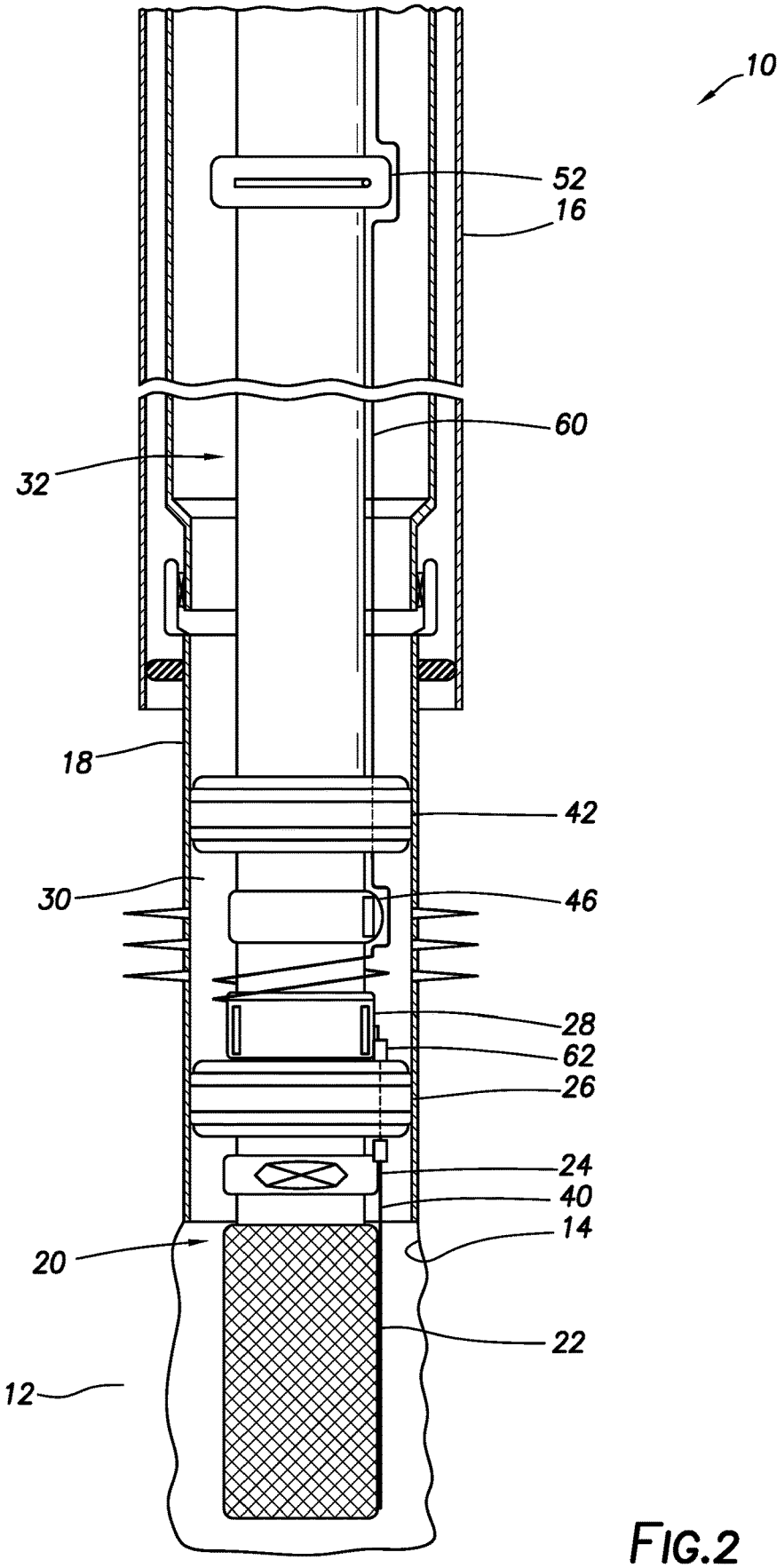
FIG. 2 is a representative partially cross-sectional view of another example of a well system and associated method which can embody the principles of this disclosure.

Referring additionally now to FIG. 2, another example of the system 10 and method is representatively illustrated. In this example, the well is used to inject fluids into (instead of produce fluids from) the formation 12.

The lower completion string 20 is similar to the lower completion string of the FIG. 1 example. However, the upper completion string 32 in the FIG. 2 example does not include the isolation packer 50, the gas lift valve 48 or the chemical injection mandrel 44. The scope of this disclosure is not limited to any particular configuration or combination of components in the lower or upper completion assemblies 20, 32, whether used for production or injection operations.

Figure 3:
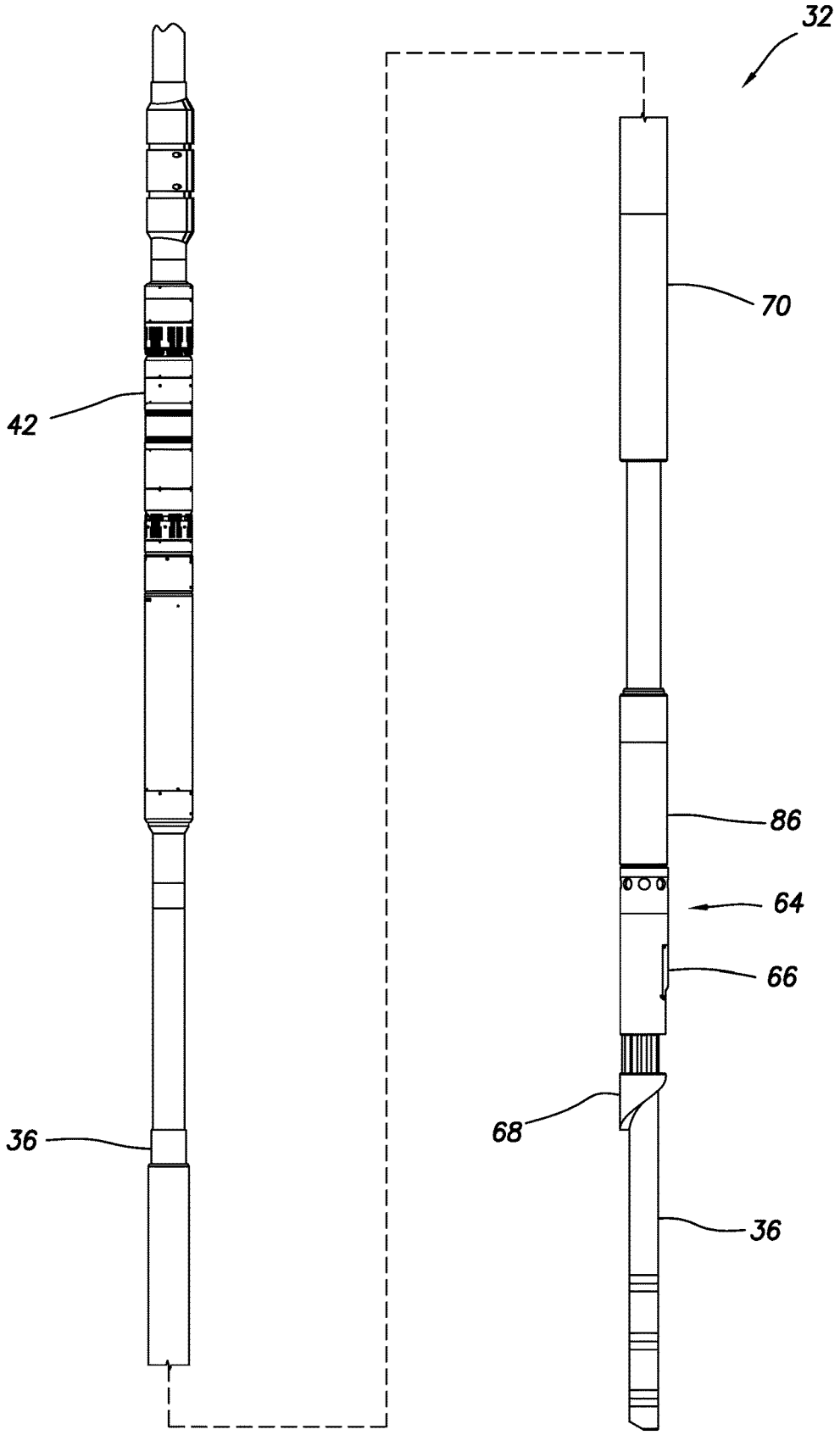
FIG. 3 is a representative side view of an example of an upper connector assembly that may be used in the well systems and methods of FIGS. 1 & 2, and which can embody the principles of this disclosure.

Referring additionally now to FIG. 3, a side view of an example of a lower section of the upper completion string 32 is representatively illustrated. In this example, the upper completion string 32 includes an upper connector assembly 64 connected below the production packer 42. The inner seal mandrel 36 is connected below the packer 42 and extends longitudinally through the upper connector assembly 64.

The upper connector assembly 64 includes a connector housing 66, a shock absorber 68, a swivel 86 and a tubing contraction joint 70. The shock absorber 68 is designed to absorb unacceptably large shocks applied to the connector housing 66, for example, during run-in and tagging the lower completion string 20.

Figure 5:
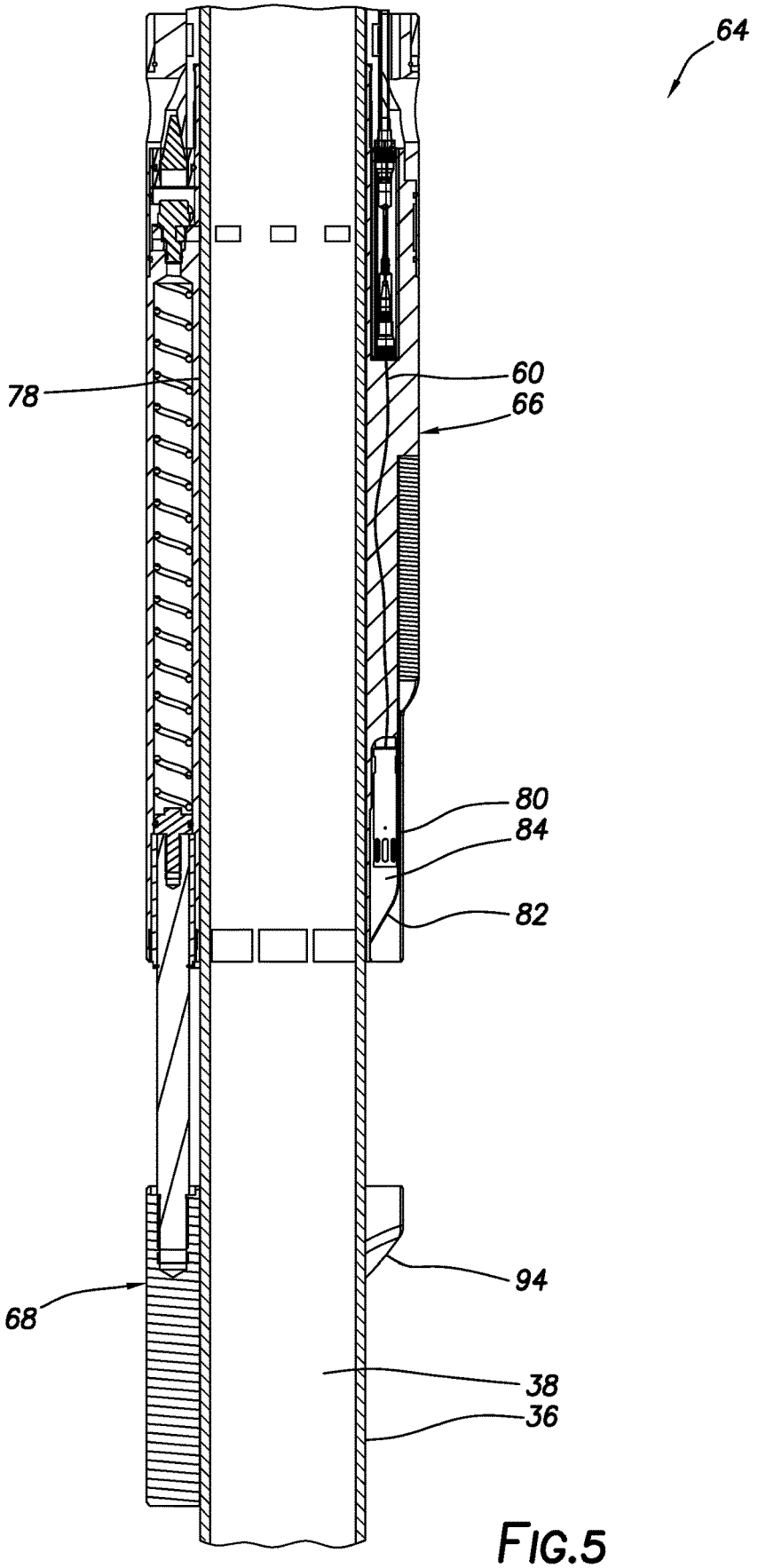
FIG. 5 is a representative cross-sectional view of a connector housing of the upper connector assembly.

In this example, the shock absorber 68 includes multiple rod pistons received in bores formed in the connector housing 66 (see FIG. 5). The bores are filled with hydraulic fluid so that, as the rod pistons displace in the bores, the hydraulic fluid is forced to flow through a flow control valve that only allows a predetermined flow rate. This dampens the displacement of the rod pistons.

The swivel 86 allows for rotation of the connector housing 66 relative to the remainder of the upper connector assembly 64 to provide for rotational alignment of the connectors 80, 92. In this example, the swivel 86 permits up to 200 degrees of rotation of the connector housing 66, without damage to the line 60.

The tubing contraction joint 70 is designed to provide for controlled landing of a tubing hanger (not shown) after landing off the upper connector assembly 64 at a fixed point on top of the lower connector assembly 90. The tubing contraction joint 70 allows the upper completion string 32 to contract longitudinally, in order to land the tubing hanger in a wellhead, for example.

Figure 4:
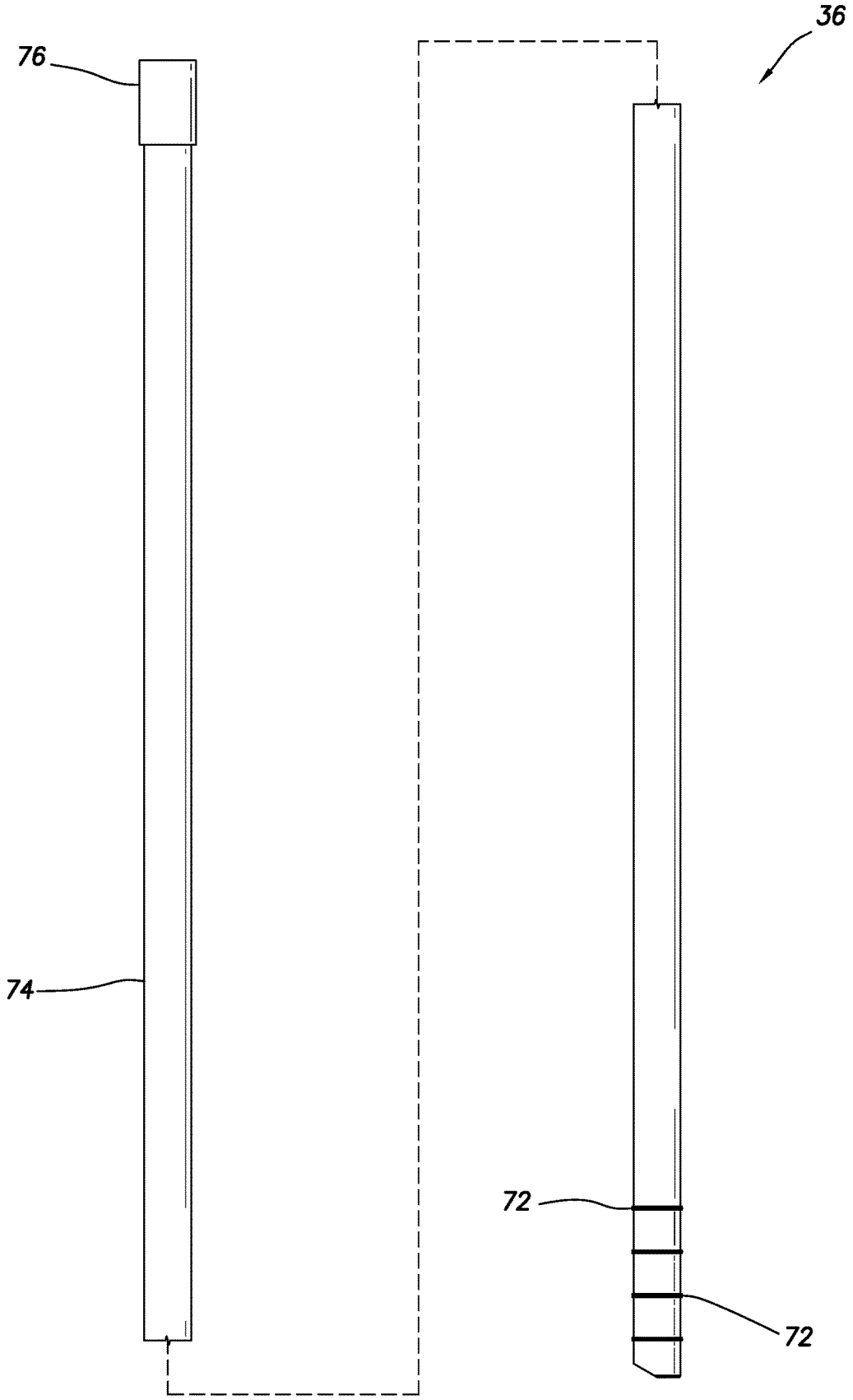
FIG. 4 is a representative side view of an inner seal mandrel of the upper connector assembly.

Referring additionally now to FIG. 4, a side view of an example of the inner seal mandrel 36 is representatively illustrated. In this view, it may be seen that the seal mandrel 36 includes a generally tubular body 74, an internally threaded upper coupling 76 and seals 72 about a lower end thereof. The seals 72 are selected for sealing engagement in the seal bore 34 of the polished bore receptacle 28. The lower end of the inner seal mandrel 36 has a configuration known to those skilled in the art as a "mule shoe" for aiding insertion of the inner seal mandrel into the polished bore receptacle 28.

Referring additionally now to FIG. 5, a cross-sectional view of the connector housing 66 of the connector assembly 64 is representatively illustrated. In this view it may be seen that an upper end of the connector housing 66 is connected to a generally tubular outer mandrel 78 extending to the swivel 86 (see FIG. 6).

The connector housing 66 contains multiple connectors 80. In this example, four of the connectors 80 are positioned in the connector housing 66, but other numbers or arrangements of connectors may be used in other examples.

The connectors 80 in this example are optical connectors for transmitting optical signals between separate sections of optical fiber or line. In other examples, connectors for electrical, hydraulic or other types of lines may also or alternatively be positioned in the connector housing 66.

Optical fibers of the optical fiber line 60 are operatively connected to the respective connectors 80. The connectors 80 are shielded from the well environment by a protective barrier 82 slidably arranged relative to the connector housing 66, so that an enclosed chamber 84 is formed between the protective barrier and the connector housing.

As described more fully below, the barrier 82 can be displaced, so that the connectors 80 are exposed, in response to engagement between the upper and lower connector assemblies 64, 90. In this manner, the connectors 80 are enclosed and protected in the chamber 84 by the barrier 82, until it is desired to operatively connect the connectors 80 with corresponding connectors 92 in the lower connector assembly 90 (see FIG. 10). When the upper and lower connector assemblies 64, 90 are engaged downhole (e.g., when the upper completion string 32 is installed in the well and connected to the lower completion string 20 in the FIGS. 1 & 2 system 10 examples), this physical contact is used to displace the barrier 82, so that the connectors 80, 92 can be operatively connected.

The shock absorber 68 includes an alignment profile 94 formed at its lower end. The alignment profile 94 is used to rotationally align the upper and lower connector assemblies 64, 90 when they are engaged downhole.

As depicted in FIG. 5, the alignment profile 94 is inclined and has a shape of the type known to those skilled in the art as a "mule shoe." However, other shapes and types of alignment devices may be used in keeping with the principles of this disclosure.

When the alignment profile 94 contacts a complementarily shaped alignment profile 96 of the lower connector assembly 90 (see FIG. 9), further axial compression of the upper and lower connector assemblies 64, 90 will maintain rotational and axial alignment of the connectors 80, 92. The engagement between the alignment profiles 94, 96 and the axial compressive force applied to them resists relative rotation between the upper and lower connector housings 66, 114 away from alignment.

Figure 6:
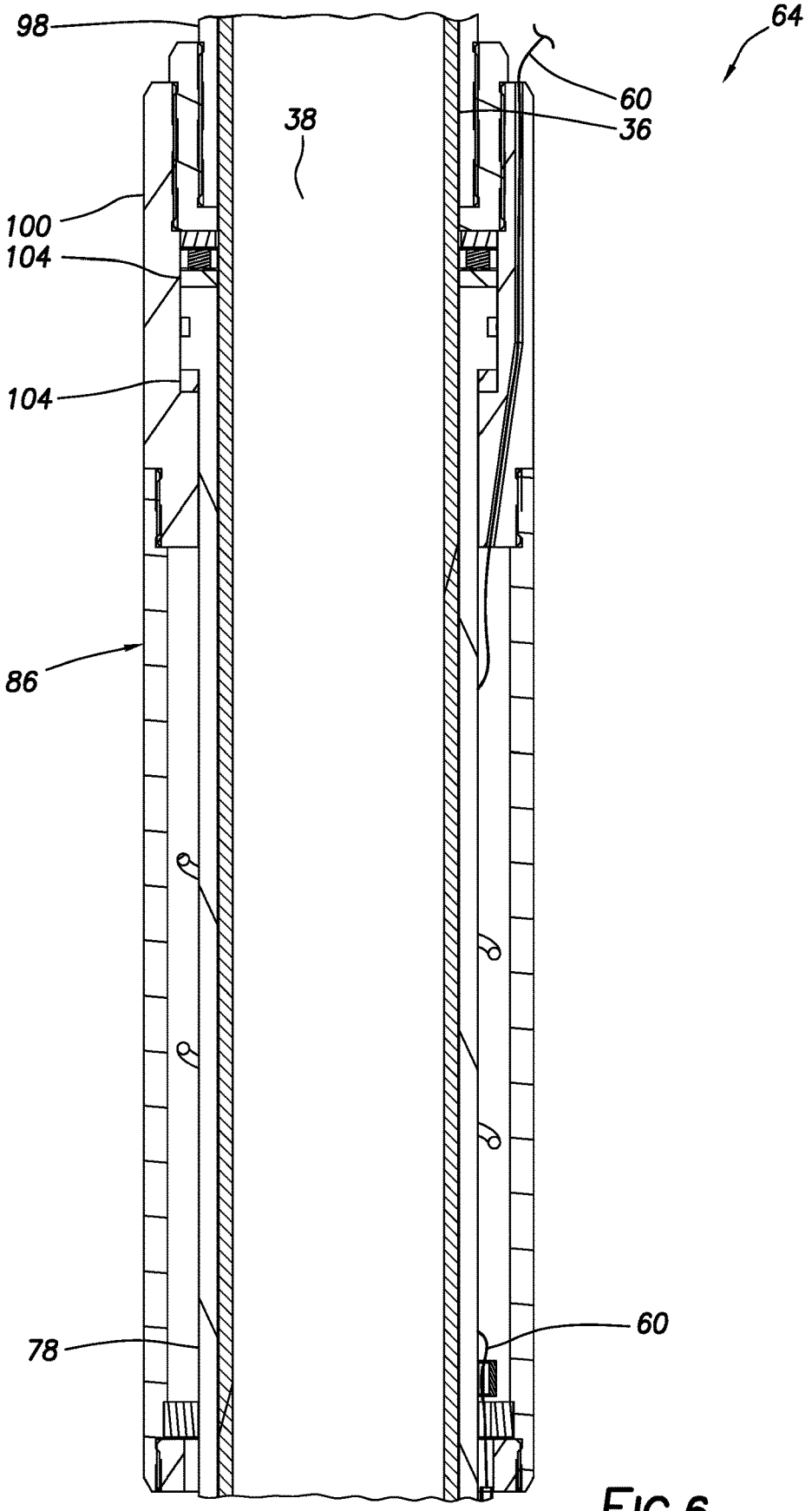
FIG. 6 is a representative cross-sectional view of a swivel of the upper connector assembly.

Referring additionally now to FIG. 6, a cross-sectional view of the swivel 86 is representatively illustrated. In this view it may be seen that the swivel 86 is arranged to transmit axial loads between the outer mandrel 78 and another outer mandrel 98 extending to the tubing contraction joint 70 (see FIG. 7).

A radially enlarged upper end of the outer mandrel 78 is initially releasably secured relative to an outer housing 100 by a shear screw 102. The radially enlarged upper end of the outer mandrel 78 is positioned between bearings 104 that are configured to facilitate relative rotation between the outer mandrels 78, 98. Thus, when the shear screw 102 is sheared due to a relatively large torque being applied to the connector housing 66 and outer mandrel 78 (such as, when the upper connector assembly 64 engages the lower connector assembly 90), the bearings 104 will act to permit limited rotation of the upper connector housing 66.

Figure 7:
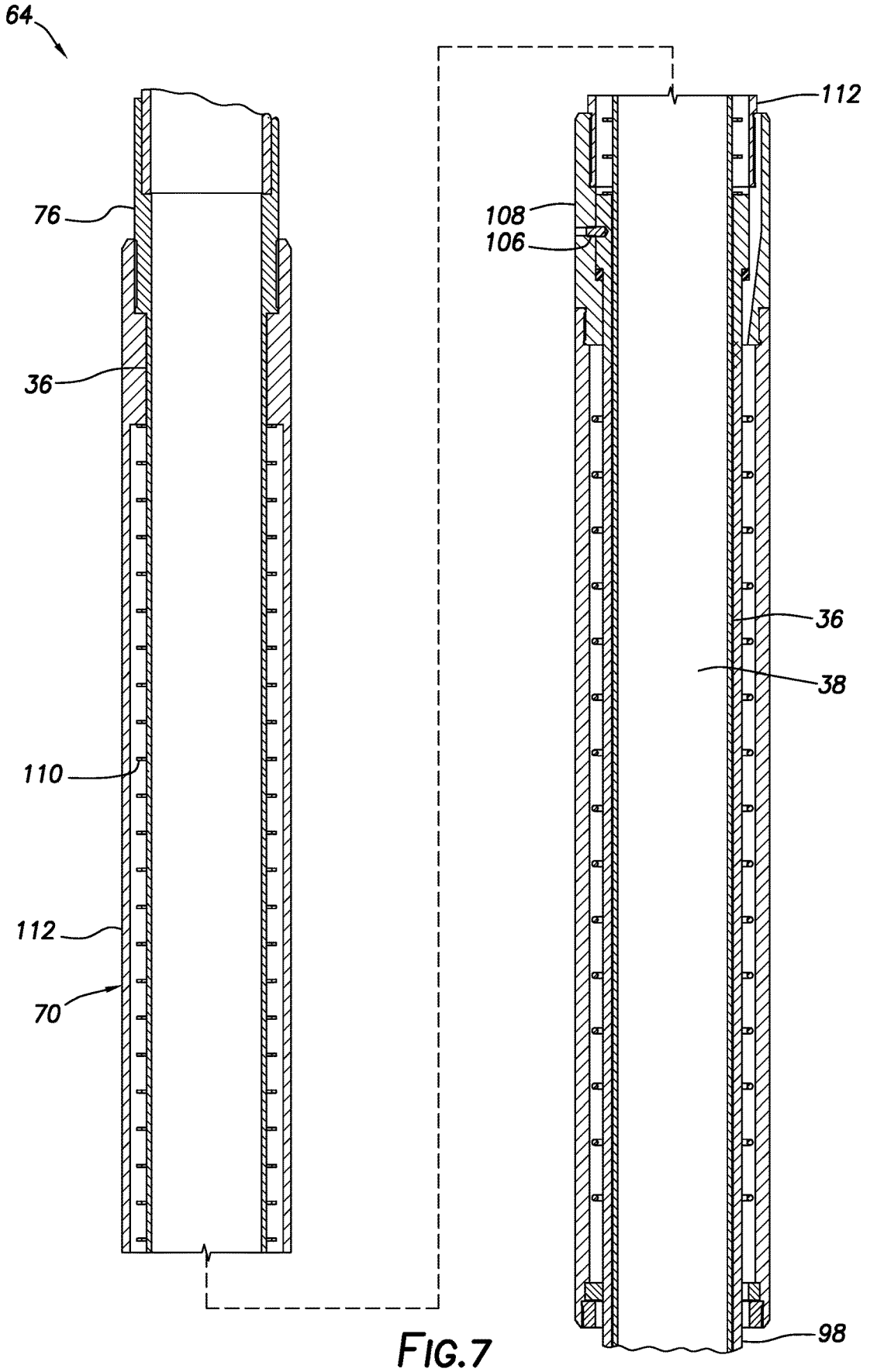
FIG. 7 is a representative cross-sectional view of a tubing contraction joint of the upper connector assembly.

Referring additionally now to FIG. 7, a cross-sectional view of the tubing contraction joint 70 is representatively illustrated. In this view it may be seen that a radially enlarged upper end of the outer mandrel 98 is initially releasably secured by a shear screw 106 against displacement relative to an outer housing 108 of the tubing contraction joint 70.

A compression spring 110 biases the outer mandrel 98 axially downward relative to the outer housing 108 and another outer housing 112 connected to the outer housing 108. The outer housing 112 is connected to the coupling 76 of the inner mandrel 36, so that the outer housings 108, 112 displace with the inner mandrel.

When the upper and lower connector assemblies 64, 90 are engaged downhole, and it is desired to land a tubing hanger at an upper end of the upper completion string 32, a sufficient axial compressive load is applied to shear the shear screw 106 and thereby permit the outer mandrel 98 to displace axially relative to the outer housings 108, 112. The packer 42 (see FIGS. 1-3) is set after the outer housings 108, 112 are displaced downward relative to the outer mandrel 98, thereby increasing compression of the spring 110. The spring 110 will continue to apply a downwardly biasing force to the outer mandrel 98 (and via the outer mandrel 78 to the connector housing 66) while the upper and lower connector assemblies 64, 90 are operatively engaged with each other.

Figure 8:
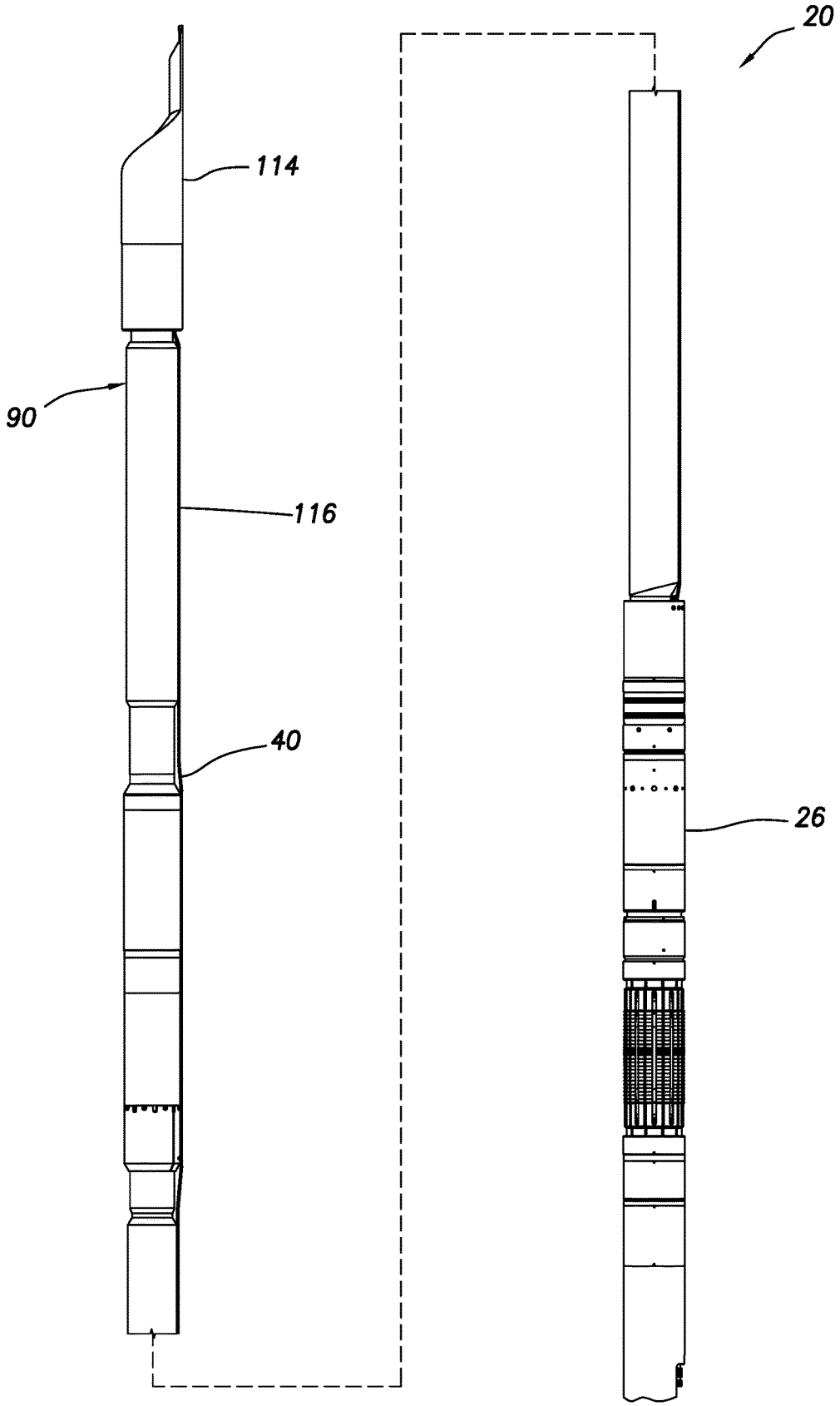
FIG. 8 is a representative side view of an example of a lower connector assembly that may be used in the well systems and methods of FIGS. 1 & 2, and which can embody the principles of this disclosure.

Referring additionally now to FIG. 8, a side view of an upper portion of an example of the lower completion string 20 is representatively illustrated. In this view it may be seen that the lower connector assembly 90 of the lower completion string 20 includes the connector housing 114, and a polished bore receptacle 116 (which may be used for the polished bore receptacle 28 in the systems 10 and methods of FIGS. 1 & 2) connected above the packer 26 for sealingly receiving the seal mandrel 36 therein.

Figure 9:
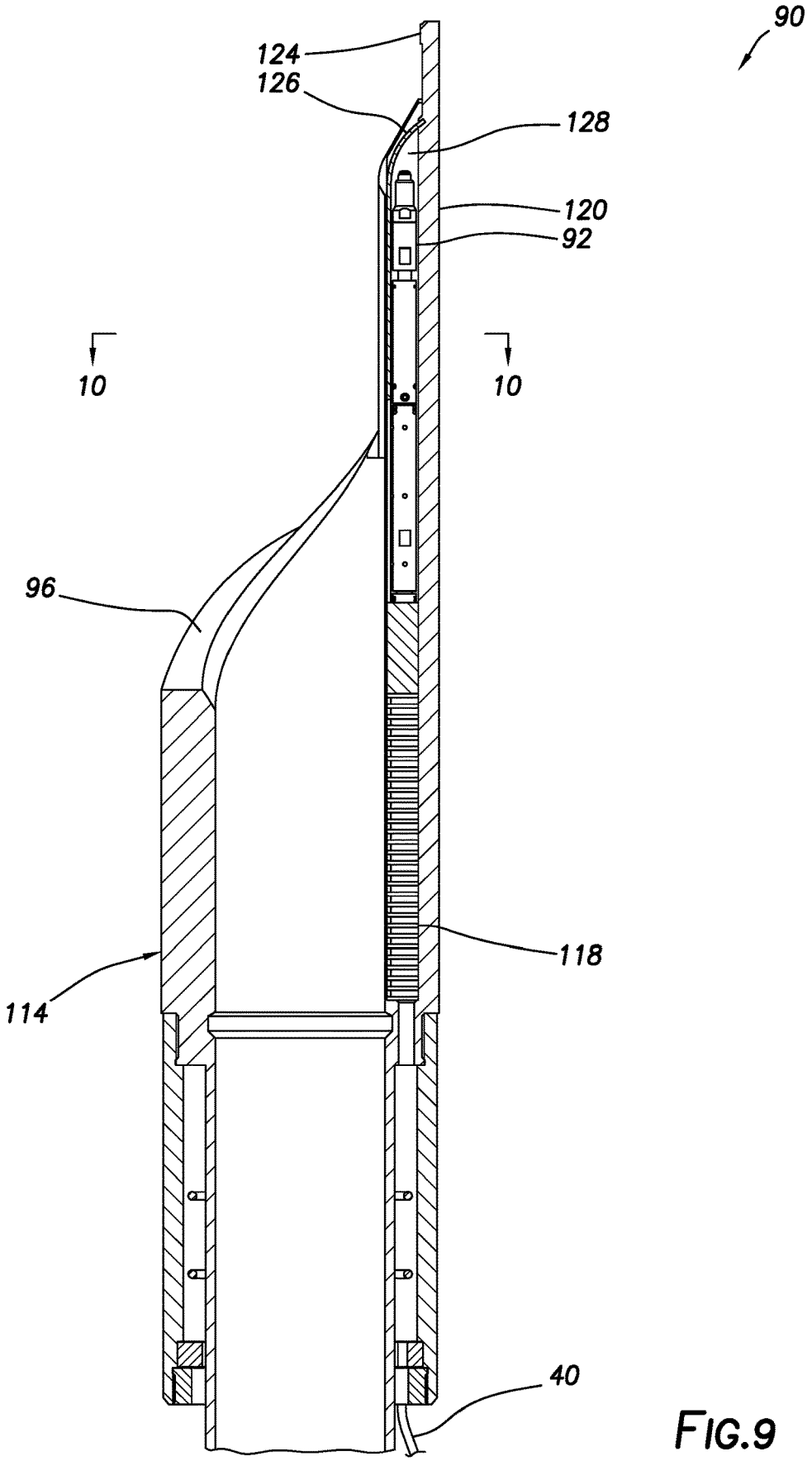
FIG. 9 is a representative cross-sectional view of a connector housing of the lower connector assembly.

Referring additionally now to FIG. 9, a cross-sectional view of the connector housing 114 is representatively illustrated. Note that the connectors 92 are arranged in the connector housing 114, so that they will be appropriately aligned with the connectors 80 in the connector housing 66 when the upper and lower connector assemblies 64, 90 are operatively engaged.

In this example, the connectors 92 are axially upwardly biased by compression springs 118 in the connector housing 114. A biasing force exerted by the springs 118 maintains the connectors 80, 92 in operative engagement, as described more fully below.

The connectors 92 are housed in an axially upwardly extending prong 120, which is slidingly received in a complementary axially extending slot 122 formed in the connector housing 66 (see FIG. 11) when the connector housings 66, 114 are rotationally aligned. Extending further axially outward from the prong 120 is an engagement device 124.

Optical fibers of the optical fiber line 40 are operatively connected to the respective connectors 92. The connectors 92 are shielded from the well environment by a protective barrier 126 slidably arranged relative to the connector housing 114, so that an enclosed chamber 128 is formed between the protective barrier and the connector housing.

As described more fully below, the barrier 126 can be displaced, so that the connectors 92 are exposed, in response to engagement between the upper and lower connector assemblies 64, 90. In this manner, the connectors 92 are enclosed and protected in the chamber 128 by the barrier 126, until it is desired to operatively connect the connectors 92 with corresponding connectors 80 in the upper connector assembly 64 (see FIG. 6). When the upper and lower connector assemblies 64, 90 are engaged downhole (e.g., when the upper completion string 32 is installed in the well and connected to the lower completion string 20 in the FIGS. 1 & 2 system 10 examples), this physical contact is used to displace the barrier 126, so that the connectors 80, 92 can be operatively connected.

Figure 10:
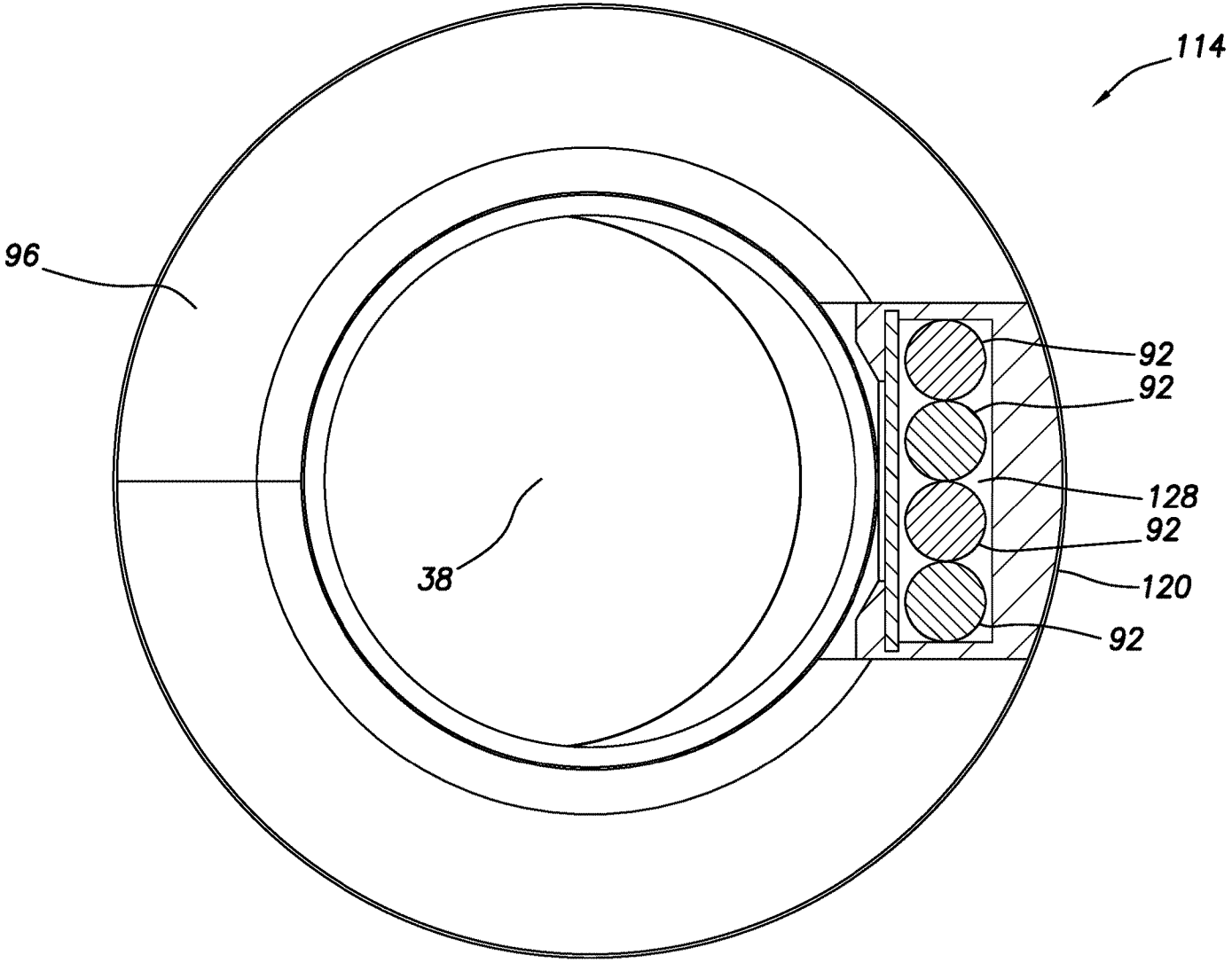
FIG. 10 is a representative cross-sectional view of the connector housing, taken along line 10-10 of FIG. 9.

Referring additionally now to FIG. 10, a cross-sectional view of the connector housing 114, taken along line 10-10 of FIG. 9, is representatively illustrated. In this view, the manner in which the connectors 92 are positioned in the chamber 128 in the prong 120 can be more clearly seen.

Figure 11:
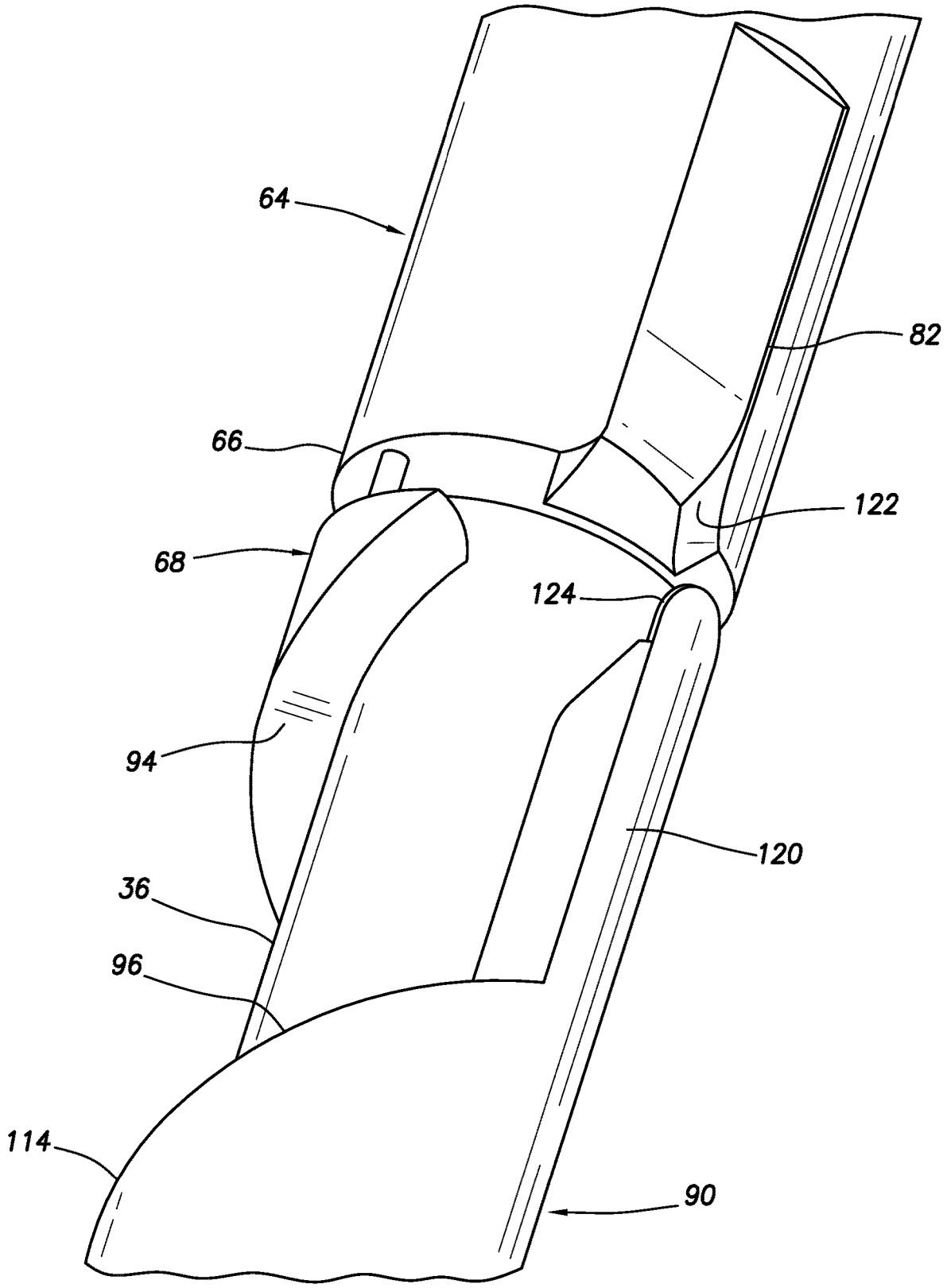
FIG. 11 is a representative perspective view of engagement between the connector housings of the upper and lower connector assemblies.

Referring additionally now to FIG. 11, a perspective view of the manner in which the upper and lower connector assemblies 64, 90 are operatively engaged downhole is representatively illustrated. Note that the prong 120 is axially received in the slot 122 as the upper and lower connector assemblies 64, 90 are engaged with each other.

The alignment profiles 94, 96 maintain the rotational alignment between the upper and lower connector assemblies 64, 90. The axial biasing force exerted by the tubing contraction joint 70 (see FIG. 7) maintains axial contact between the alignment profiles 94, 96.

As described more fully below, the engagement device 124 engages the protective barrier 82 to thereby expose the connectors 80 in the connector housing 66 when the prong 120 is received in the slot 122. A similar engagement device of the upper connector assembly 64 engages the protective barrier 126 of the lower connector assembly 90 when the upper and lower connector assemblies are engaged.

Figure 12:
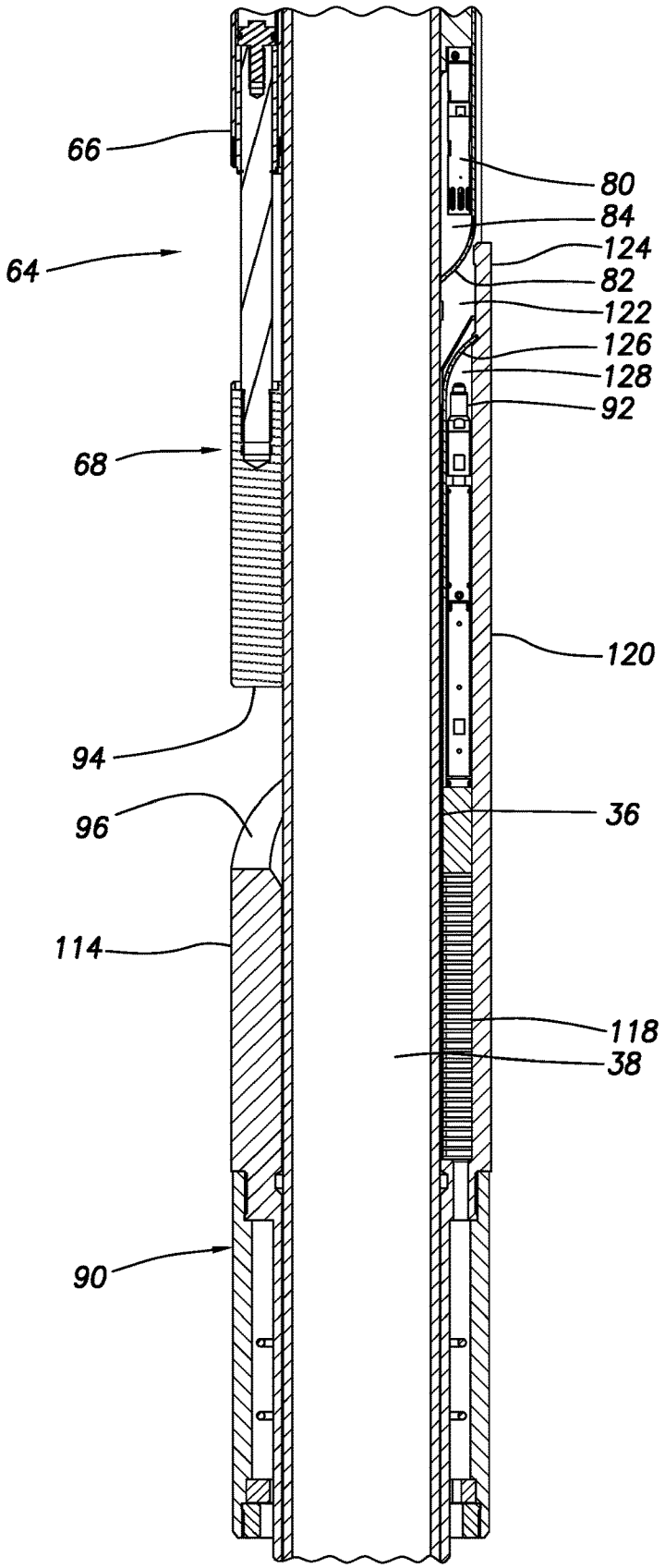
FIG. 12 is a representative cross-sectional view of the upper and lower connector assemblies engaged and rotationally aligned with each other.
Figure 13:
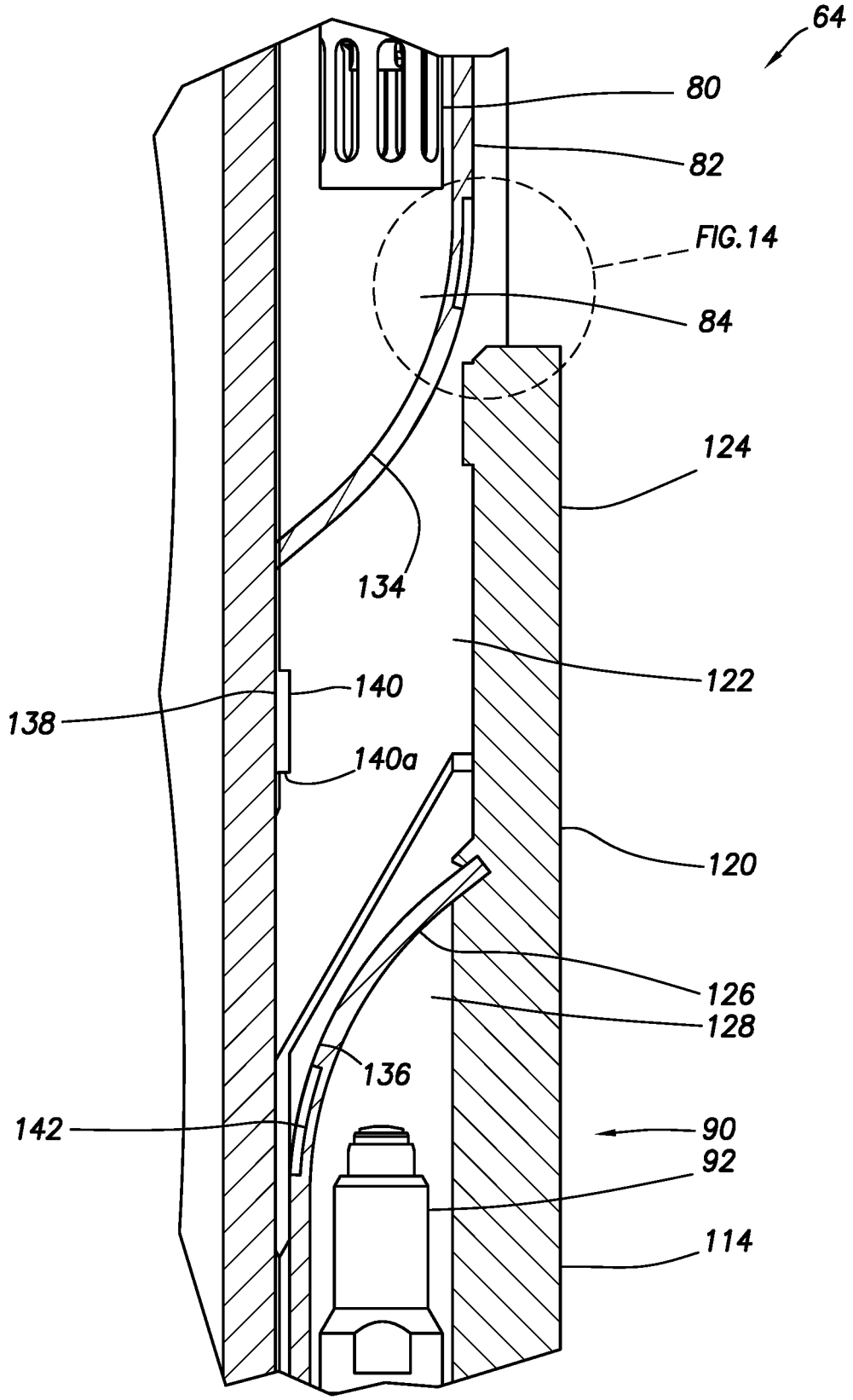
FIG. 13 is a representative cross-sectional view of aligned upper and lower connectors and protective barriers for the connectors.

Referring additionally to FIGS. 12 & 13, cross-sectional views of the upper and lower connector assemblies 64, 90 are representatively illustrated. The upper and lower connector assemblies 64, 90 are rotationally aligned in these views, but are not yet operatively connected.

The prong 120 is received in the slot 122. The protective barriers 82, 126 continue to shield the respective connectors 80, 92 from the well environment.

Figure 14:
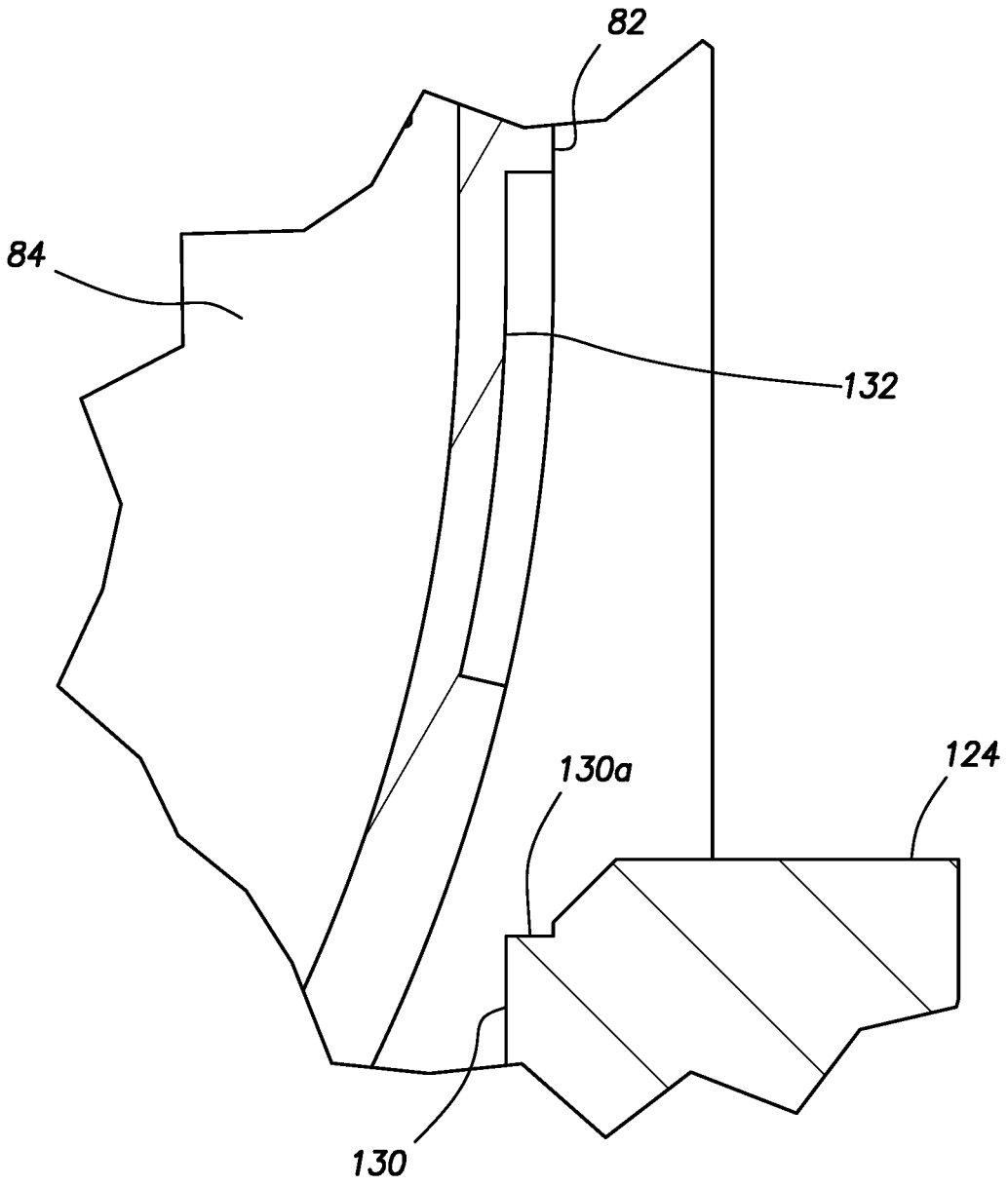
FIG. 14 is a representative cross-sectional view of a recess in a protective barrier aligned with a projection of the lower connector assembly.

Referring additionally now to FIG. 14, an enlarged view of the protective barrier 82 and the engagement device 124 is representatively illustrated. In this view it may be seen that the engagement device 124 comprises an inwardly extending projection 130 having a lateral shoulder 130*a* formed thereon.

The barrier 82 has a recess 132 formed therein. In this example, the recess 132 is complementarily shaped relative to the projection 130. When the projection 130 is cooperatively received in the recess 132, the barrier 82 and the engagement device 124 will displace axially together. Shoulders (such as the shoulder 130*a*) on the projection 130 and in the recess 132 can engage each other to thereby prevent relative axial displacement between the engagement device 124 and the barrier 82.

Since the engagement device 124 is part of the lower connector assembly 90 and the barrier 82 is part of the upper connector assembly 64, this means that the barrier 82 will displace axially with the lower connector assembly 90 relative to the upper connector assembly 64 when the connector assemblies are engaged.

An engagement device 138 (see FIG. 13) of the upper connector assembly 64 includes an outwardly extending projection 140 having a lateral shoulder 140*a* formed thereon. The barrier 126 has a recess 142 formed therein.

In this example, the recess 142 is complementarily shaped relative to the projection 140. When the projection 140 is cooperatively received in the recess 142, the barrier 126 and the engagement device 138 will displace axially together. Shoulders (such as the shoulder 140*a*) on the projection 140 and in the recess 142 can engage each other to thereby prevent relative axial displacement between the engagement device 138 and the barrier 126.

Since the engagement device 138 is part of the upper connector assembly 64 and the barrier 126 is part of the lower connector assembly 90, this means that the barrier 126 will displace axially with the upper connector assembly 64 relative to the lower connector assembly 90 when the connector assemblies are engaged.

Figure 15:
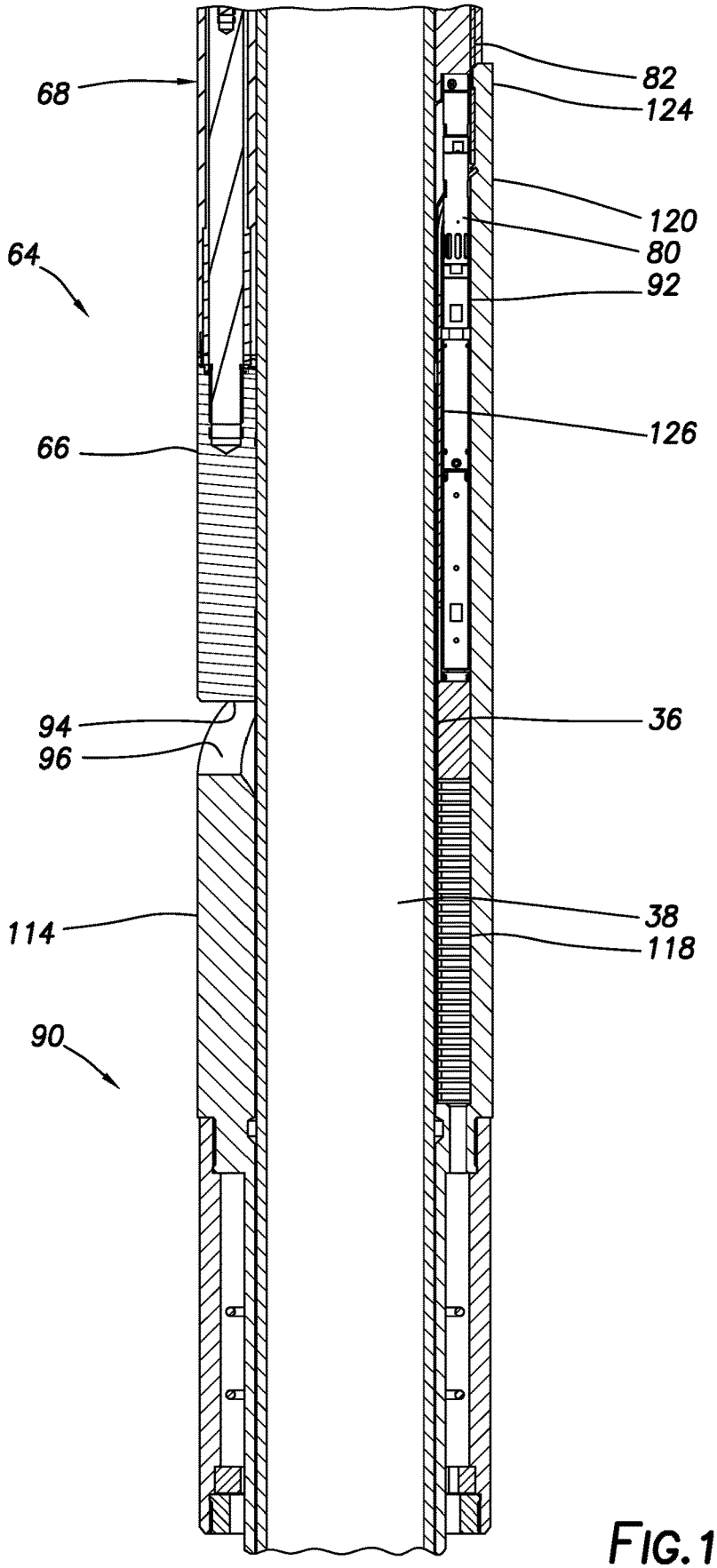
FIG. 15 is a representative cross-sectional view of the operatively engaged upper and lower connector assemblies.
Figure 16:
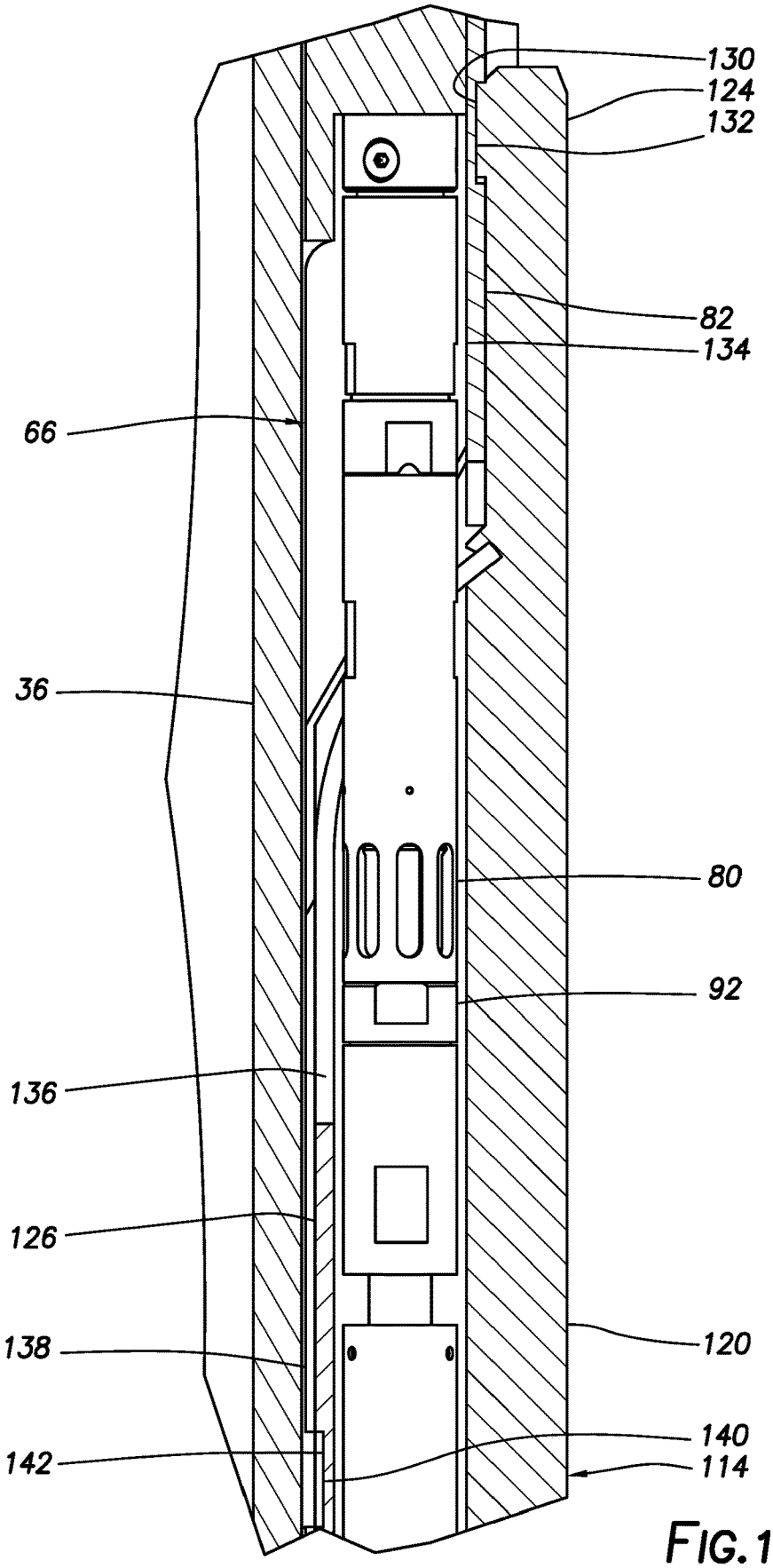
FIG. 16 is a representative cross-sectional view of the operatively engaged connectors.

Referring additionally now to FIGS. 15 & 16, cross-sectional views of the upper and lower connector assemblies 64, 90 are representatively illustrated. The connector assemblies 64, 90 are operatively engaged in the configuration depicted in FIGS. 15 & 16.

The connectors 80, 92 are operatively connected, so that signals (such as communication or power signals) can be transmitted between the connectors. Note that the barriers 82, 126 are displaced along respective slots or tracks 134, 136 formed in the upper and lower connector housings 66, 114.

The barriers 82, 126 slide in the respective tracks 134, 136 after they have been engaged by the respective engagement devices 124, 138 and there is relative displacement between the upper and lower connector assemblies 64, 90. Note that the barriers 82, 126 can displace in either axial direction in the tracks 134, 136 and, thus, the barriers can be re-closed (after having been opened downhole) when the upper and lower connector assemblies 64, 90 are disengaged from each other downhole (such as, when the upper completion string 32 is retrieved from the well).

As depicted in FIGS. 15 & 16, the barriers 82, 126 are displaced to their open positions, and the chambers 84, 128 are open so that the connectors 80, 92 are exposed to each other. The connectors 80, 92 are operatively engaged with each other after the barriers 82, 126 are displaced to their open positions, and before the alignment profiles 94, 96 are fully engaged.

Figure 17:
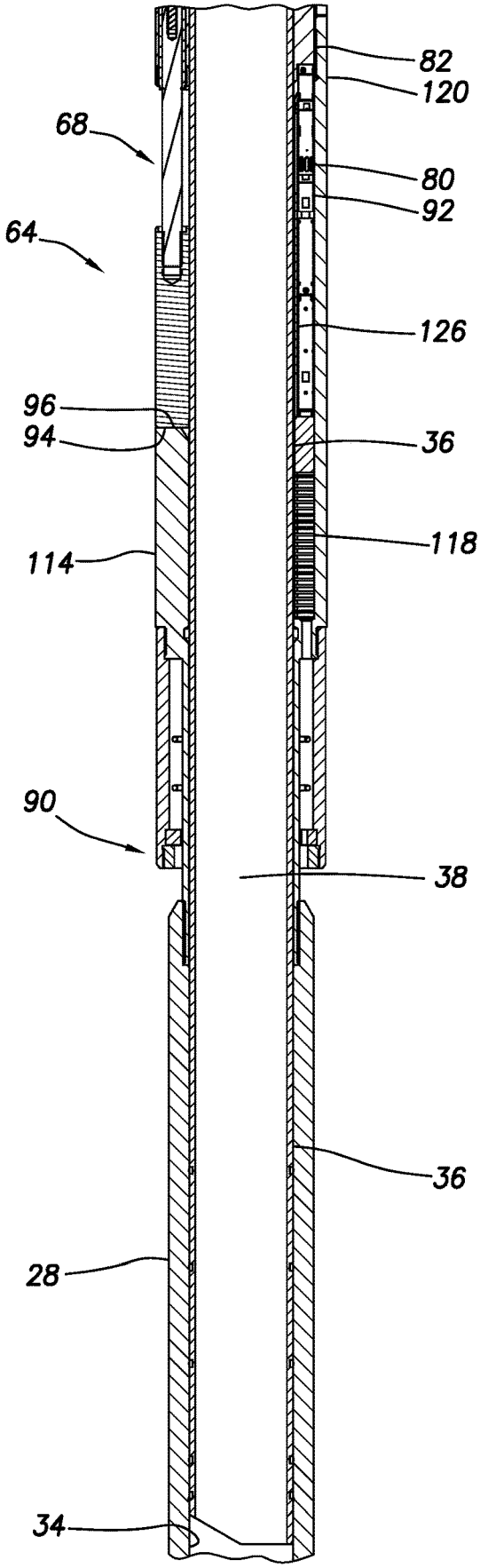
FIG. 17 is a representative cross-sectional view of the upper and lower connector assemblies at full engagement.
Figure 18:
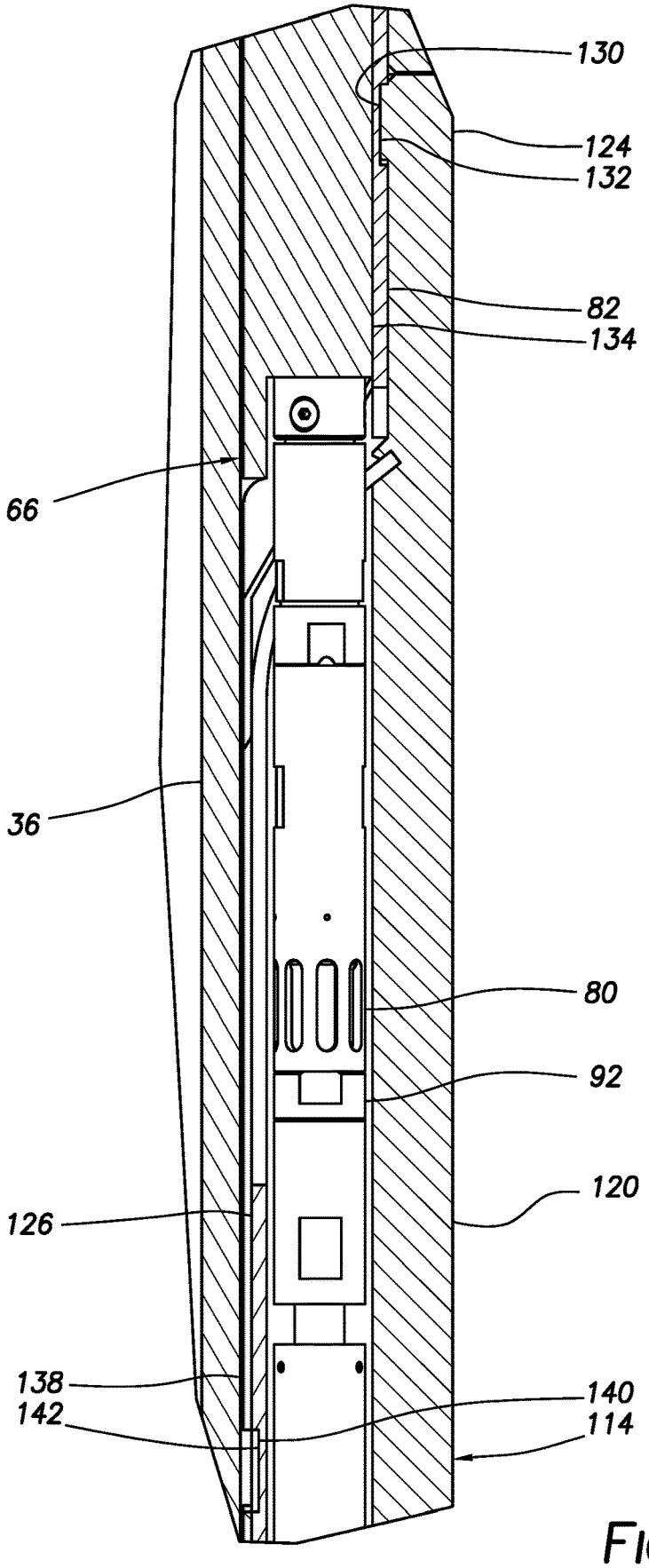
FIG. 18 is a representative cross-sectional view of the fully engaged connectors.

Referring additionally now to FIGS. 17 & 18, cross-sectional views of the upper and lower connector assemblies 64, 90 are representatively illustrated. The connector assemblies 64, 90 are fully engaged with each other in the configuration depicted in FIGS. 17 & 18.

A compressive force has been applied after the alignment profiles 94, 96 are fully engaged, for example, by slacking off weight of the upper completion string 32 at the surface (e.g., during setting of the production packer 42 if it is a mechanically set packer). The tubing contraction joint 70 maintains the compressive force in the connected upper and lower connector assemblies 64, 90 after the packer 42 is set, as described above.

Note that the springs 118 are additionally compressed in the lower connector assembly 90. This additional compression begins just after the connectors 80, 92 are operatively connected and ends when the connector assemblies 64, 90 are fully engaged with each other (e.g., when the alignment profiles 94, 96 fully contact each other). The compressive biasing force exerted by the springs 118 helps to maintain the operative engagement of the connectors 80, 92.

The protective barriers 82, 126 are depicted in the drawings as being in single flexible sheet or flat form. However, in other examples, the barriers 82, 126 could each comprise multiple connected-together components, and the barriers could have shapes other than sheet or flat. Thus, the scope of this disclosure is not limited to any particular form, shape, configuration or arrangement of the barriers 82, 126.

The tracks 134, 136 in the respective upper and lower connector assemblies 64, 90 are depicted in the drawings as being axially elongated slots or grooves formed in the upper and lower connector housings 66, 114. In other examples, the tracks could comprise structures (such as rails, guides or shoulders) that engage cooperative recesses or structures on the barriers 82, 126. Thus, the scope of this disclosure is not limited to any particular configuration of the engagement between the barriers 82, 126 and the tracks 134, 136.

Similarly, the scope of this disclosure is not limited to any particular configuration of the engagement between the engagement devices 124, 138 and the respective barriers 82, 126. In some examples, projections or other structures on the barriers 82, 126 could engage recesses or structures of the engagement devices 124, 138.

The chambers 84, 128 may initially be filled with a clean, viscous substance (such as, silicone grease) when the lower completion string 20 is installed in the well, and then the upper completion string 32 is run into the well to connect with the lower completion string. The substance can help to exclude debris from the chambers 84, 128 and minimize well fluid entry into the chambers. The chambers 84, 128 and the substance therein are then exposed to the downhole environment only just before the connectors 80, 92 are operatively connected.

Although use of the principles of this disclosure to make an optical wet mate connection 62 between optical fiber lines 40, 60 is described above, it will be appreciated that the same principles may be applied to making wet mate electrical, hydraulic or other types of connections. Thus, the lines 40, 60 could instead, or in addition, comprise any type or combination of lines (such as, electrical, hydraulic and/or optical lines).

It may now be fully appreciated that the above disclosure provides significant advancements to the art of making downhole wet mate connections in wells. In an example described above, the upper and lower connector assemblies 64, 90 are uniquely configured to provide for a convenient and reliable wet mate connection 62 between the lines 40, 60.

The above disclosure provides to the art a wet mate connection 62 for use in a subterranean well. In one example, the connection 62 can comprise first and second connector assemblies 90, 64. The first connector assembly 90 includes at least one first connector 92 and a first protective barrier 126, the first protective barrier 126 being displaceable between closed and open positions. The second connector assembly 64 includes a first engagement device 138 that displaces the first protective barrier 126 from the closed position to the open position in response to engagement between the first and second connector assemblies 90, 64.

The first connector assembly 90 may include a seal bore 34 that sealingly receives therein a seal mandrel 36 of the second connector assembly 64 when the first and second connector assemblies 90, 64 are engaged.

The second connector assembly 64 may include at least one second connector 80 and a second protective barrier 82, the second protective barrier 82 being displaceable between closed and open positions. The first connector assembly 90 may include a second engagement device 124 that displaces the second protective barrier 82 from the closed position to the open position in response to the engagement between the first and second connector assemblies 90, 64.

The second connector assembly 64 may include a tubing contraction joint 70 that permits longitudinal compression of the second connector assembly 64 between a packer 42 and a connector housing 66 of the second connector assembly 64.

The first protective barrier 126 may be displaceable along a track 136 formed on the first connector assembly 90. The first protective barrier 126 may include a recess 142 configured for engagement with the first engagement device 138.

The first connector 92 may comprise an optical connector.

The above disclosure also provides to the art a method of making a connection 62 between lines 40, 60 in a subterranean well. In one example, the method can comprise: installing a first connector assembly 90 in the well, the first connector assembly 90 comprising a first connector 92 and a first alignment profile 96; then installing a second connector assembly 64 in the well, the second connector assembly 64 comprising a second connector 80 and a second alignment profile 94; then axially engaging the first and second connector assemblies 90, 64, thereby opening first and second protective barriers 126, 82 for the respective first and second connectors 92, 80, and operatively connecting the first and second connectors 92, 80, and engaging the first and second alignment profiles 96, 94, thereby preventing rotational misalignment of the first and second connectors 92, 80.

The operatively connecting step may be performed after the first and second protective barriers 126, 82 opening step.

The first and second protective barriers 126, 82 opening step may include displacing the first protective barrier 126 with the second connector assembly 64, and displacing the second protective barrier 82 with the first connector assembly 90.

The first and second protective barriers 126, 82 opening step may include sliding the first protective barrier 126 relative to a first track 136 formed on the first connector assembly 90, and sliding the second protective barrier 82 relative to a second track 134 formed on the second connector assembly 64.

The method can include axially separating the first and second connector assemblies 90, 64, thereby closing the first and second protective barriers 126, 82 for the respective first and second connectors 92, 80.

The operatively connecting step may permit optical communication between the first and second connectors 92, 80.

A system 10 for use with a subterranean well is also described above. In one example, the system 10 can include: a first completion string 20 comprising a first optical connector assembly 90, the first optical connector assembly 90 including at least one first optical connector 92, a first packer 26 and a seal bore 34; and a second completion string 32 comprising a second optical connector assembly 64, the second optical connector assembly 64 including at least one second optical connector 80, a second packer 42 and a seal mandrel 36 sealingly engaged in the seal bore 34. The first and second optical connectors 92, 80 are operatively engaged between the first and second packers 26, 42.

The first optical connector assembly 90 may include a first protective barrier 126 displaceable between closed and open positions. The second optical connector assembly 64 may include a first engagement device 138 that displaces the first protective barrier 126 from the closed position to the open position in response to engagement between the first and second optical connector assemblies 90, 64.

The second optical connector assembly 64 may include a second protective barrier 82 displaceable between closed and open positions. The first optical connector assembly 90 may include a second engagement device 124 that displaces the second protective barrier 82 from the closed position to the open position in response to the engagement between the first and second optical connector assemblies 90, 64.

The first protective barrier 126 may be displaceable along a track 136 formed on the first optical connector assembly 90. The first protective barrier 126 may include a recess 142 configured for engagement with the first engagement device 138.

The second optical connector assembly 64 may include a tubing contraction joint 70 that permits longitudinal compression of the second completion string 32 between the second packer 42 and the second optical connector assembly 64.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used.

Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A wet mate connection for use in a subterranean well, the connection comprising:

first and second connector assemblies, the first connector assembly including at least one first connector and a first protective barrier, the first protective barrier comprising a flexible member which slides within a curved track formed on the first connector assembly, and the first protective barrier being displaceable between closed and open positions, and the second connector assembly including a first engagement device that displaces the first protective barrier from the closed position to the open position in response to engagement between the first and second connector assemblies.

2. The wet mate connection of claim 1, in which the first connector assembly includes a seal bore that sealingly receives therein a seal mandrel of the second connector assembly when the first and second connector assemblies are engaged.

3. The wet mate connection of claim 1, in which the second connector assembly includes at least one second connector and a second protective barrier, the second protective barrier being displaceable between closed and open positions, and the first connector assembly includes a second engagement device that displaces the second protective barrier from the closed position to the open position in response to the engagement between the first and second connector assemblies.

4. The wet mate connection of claim 1, in which the second connector assembly includes a tubing contraction joint that permits longitudinal compression of the second connector assembly between a packer and a connector housing of the second connector assembly.

5. The wet mate connection of claim 1, in which the first protective barrier includes a recess configured for engagement with the first engagement device.

6. The wet mate connection of claim 1, in which the first connector comprises an optical connector.

7. A method of making a connection between lines in a subterranean well, the method comprising:

installing a first connector assembly in the well, the first connector assembly comprising a first connector and a first alignment profile;

then installing a second connector assembly in the well, the second connector assembly comprising a second connector and a second alignment profile; and then axially engaging the first and second connector assemblies, thereby: a) opening first and second protective barriers for the respective first and second connectors, the first and second protective barriers each comprising a flexible member which slides within a curved track formed respectively on the first and second connector assemblies, b) operatively connecting the first and second connectors, and c) engaging the first and second alignment profiles, thereby preventing rotational misalignment between the first and second connectors.

8. The method of claim 7, in which the operatively connecting is performed after the first and second protective barriers opening.

9. The method of claim 7, in which the first and second protective barriers opening comprises displacing the first protective barrier with the second connector assembly, and displacing the second protective barrier with the first connector assembly.

10. The method of claim 7, in which the first and second protective barrier opening comprises engaging a first engagement device with a first recess formed on the first protective barrier, and engaging a second engagement device with a second recess formed on the second protective barrier.

11. The method of claim 7, further comprising axially separating the first and second connector assemblies, thereby closing the first and second protective barriers for the respective first and second connectors.

12. The method of claim 7, in which the operatively connecting permits optical communication between the first and second connectors.

13. A system for use with a subterranean well, the system comprising:

a first completion string comprising a first optical connector assembly, the first optical connector assembly including at least one first optical connector, a first protective barrier, a first packer and a seal bore; and a second completion string comprising a second optical connector assembly, the second optical connector assembly including at least one second optical connector, a second protective barrier, a second packer and a seal mandrel sealingly engaged in the seal bore, the first and second optical connectors being operatively engaged between the first and second packers, in which the first and second protective barriers each comprise a flexible member which slides within a curved track formed respectively on the first and second connector assemblies.

14. The system of claim 13, in which the first protective barrier is displaceable between closed and open positions, and the second optical connector assembly includes a first engagement device that displaces the first protective barrier from the closed position to the open position in response to engagement between the first and second optical connector assemblies.

15. The system of claim 14, in which the first protective barrier includes a first recess configured for engagement with the first engagement device.

16. The system of claim 13, in which the second protective barrier is displaceable between closed and open positions, and the first optical connector assembly includes a second engagement device that displaces the second protective barrier from the closed position to the open position in response to the engagement between the first and second optical connector assemblies.

17. The system of claim 16, in which the second protective barrier includes a second recess configured for engagement with the second engagement device.

18. The system of claim 13, in which the second optical connector assembly includes a tubing contraction joint that permits longitudinal compression of the second completion string between the second packer and the second optical connector assembly.

* * * * *